US005091673A

United States Patent [19]

Shimoma et al.

[11] Patent Number: 5,091,673

[45] Date of Patent: Feb. 25, 1992

[54] COLOR CATHODE RAY TUBE APPARATUS

[75] Inventors: Taketoshi Shimoma, Isesaki; Eiji Kamohara, Fukaya; Shigeru Sugawara, Saitama; Jiro Shimokobe, Fukaya, all of Japan

[73] Assignee: Kabushiki Kaisha Toshba, Kawasaki, Japan

[21] Appl. No.: 413,547

[22] Filed: Sep. 27, 1989

[30] Foreign Application Priority Data

Sep. 28, 1988 [JP] Japan ..... 63-240809
Oct. 17, 1988 [JP] Japan ..... 63-259392

[51] Int. Cl.[5] ..... H01J 29/51
[52] U.S. Cl. ..... 313/412
[58] Field of Search ..... 313/412, 414, 413, 428, 313/458, 460

[56] References Cited

U.S. PATENT DOCUMENTS

| | | | |
|---|---|---|---|
| 4,086,513 | 4/1978 | Evans, Jr. | 313/458 X |
| 4,406,970 | 9/1983 | Hughes | 313/460 X |
| 4,649,318 | 3/1987 | Kikuchi et al. | 313/460 X |
| 4,766,344 | 8/1988 | Say | 313/414 |
| 4,870,321 | 9/1989 | Kamohara | 313/414 |

FOREIGN PATENT DOCUMENTS

| | | |
|---|---|---|
| 53-69 | 1/1978 | Japan . |
| 64-31333 | 2/1989 | Japan . |

*Primary Examiner*—Donald J. Yusko
*Assistant Examiner*—Michael Horabik
*Attorney, Agent, or Firm*—Cushman, Darby & Cushman

[57] ABSTRACT

A color cathode ray tube apparatus is provided with an electron gun which has a common large-aperture electron lens on which three electron beams are incident. Since the electron gun has individual electron lenses for individual electron beams, the electron beams can be properly converged and focused on a screen. Thus, the apparatus enjoys a satisfactory picture characteristic.

18 Claims, 15 Drawing Sheets

COLOR CATHODE RAY TUBE APPARATUS

BACKGROUND OF THE INVENTION

1. Field of the Invention

The present invention relates to a color cathode ray tube apparatus, and more particularly, to a color cathode ray tube apparatus having an electron gun assembly, in which three electron beams arranged in line are focused and converged by means of a large-aperture electron lens common to the beams.

2. Description of the Related Art

FIG. 1 shows a conventional color cathode ray tube apparatus. Color cathode ray tube apparatus 1 comprises envelope 11 which includes panel section 2, funnel section 8 bonded to panel section 2, and neck section 10 continuous with funnel section 8. Panel section 2 has which is substantially rectangular face plate 4 and skirt 6 extending from the peripheral edge of plate 4. The inside of the color cathode ray tube is kept at a vacuum by sections 2, 8 and 10. Electron gun assembly 12 is used for emitting three electron beams $B_R$, $B_G$, and $B_B$ and is housed inside neck section 10. Deflecting device 14 is mounted on the outer peripheral surfaces of funnel and neck sections 8 and 10 respectively. The deflecting device serves to generate magnetic fields in order to deflect electron beams $B_R$, $B_G$, and $B_B$ horizontally and vertically. Phosphor screen 16 is formed on the inner surface of face plate 4 of panel section 2. Inside the tube, shadow mask 18, which is substantially rectangular in shape, is arranged opposite screen 16 so that a predetermined space is kept between mask 18 and face plate 4. Mask 18, which is formed of a metal sheet, has a number of perforations 20. Internal conductor film 22 is applied to the inner wall surface of a boundary portion between funnel and neck sections 8 and 10, while external conductor film 24 is applied to the outer wall surface of funnel section 8.

Three electron beams $B_R$, $B_G$, and $B_B$ emitted from their corresponding electron guns of electron gun assembly 12 are deflected by means of deflecting device 14. The deflected beams are converged in the vicinity of perforations 20 of shadow mask 18. Converged in this manner, electron beams $B_R$, $B_G$, and $B_B$ land on specific regions of phosphor screen 16 which glow with three colored lights, red, green, and blue, respectively. Thus, beams $B_R$, $B_G$, and $B_B$ from assembly 12 cause screen 16 to glow with red, green, and blue lights, respectively.

Electron gun assembly 12 includes electron beam forming unit GE for generating, accelerating, and controlling electron beams $B_R$, $B_G$, and $B_B$ to be emitted in line, and main electron lens unit ML for focusing and converging the electron beams. Electron beams $B_R$, $B_G$, and $B_B$ are deflected by deflecting device 14 to be used to scan phosphor screen 16, thus forming a raster.

There are some conventional methods for converging three electron beams. One of these methods is disclosed in U.S. Pat. No. 2,957,106, in which an electron beam emitted from a cathode is initially skewed before it is converged. In another method disclosed in U.S. Pat. No. 3,772,554, electron beams are converged in an arrangement such that two outside openings, out of three openings in an electrode of an electron gun, are slightly outwardly eccentric to the central axis of the electron gun.

The deflecting device includes a horizontal deflecting coil, for horizontally deflecting the electron beams, and a vertical deflecting coil, for vertically deflecting the electron beams. When the three electron beams are deflected by means of the deflecting device, in the conventional color cathode ray tube apparatus, they cannot be accurately converged on the phosphor screen. Therefore, some measures have been taken to converge the electron beams accurately. Among these measures, there is a method called a convergence-free system, in which horizontal and vertical deflecting magnetic fields are generated in the forms of a pincushion and a barrel, respectively, whereby the three electron beams are converged.

In this convergence-free system, the electron beams suffer deflective aberration produced by the pincushion-type horizontal deflecting magnetic field. At a horizontal end portion of the screen, therefore, spots of the electron beams suffer halos. Thus, the picture quality is considerably lowered.

Large-sized color cathode ray tube apparatuses of high quality have recently been coming into wide use. These apparatuses, however, have the following problems.

(1) The diameter of beam spots on the phosphor screen.

(2) Distortion of the beam spots on the peripheral region of the phosphor screen caused when the electron beams are deflected.

(3) Convergence of the electron beams on the whole surface of the phosphor screen.

In the large-sized color cathode ray tube apparatuses, the distance from the electron gun to the phosphor screen is long, so that the electrooptical magnification of an electron lens is high. Accordingly, the diameter of the beam spots on the phosphor screen is so long that the resolution is low. Thus, in order to reduce the spot diameter, the performance of the electron lens of the electron gun must be improved.

In general, the main electron lens unit is arranged so that a plurality of electrodes, each having apertures, are coaxially arranged, and a predetermined voltage is applied to each of the electrodes. Electrostatic lenses, such as the main electron lens unit, may be classified into several types, depending on the electrode configuration. Basically, the lens performance can be improved by forming a large-aperture lens with large electrode apertures, or by lengthening the distance between the electrodes to change the potential slowly, thereby forming a long-focus lens.

In the color cathode ray tube apparatuses, however, the electron gun is housed inside a neck, formed of a slender glass cylinder, so that the diameter of the electrode aperture, i.e., lens aperture, is physically restricted. Also, the distance between the electrodes is limited, in order to prevent converging electric fields formed between the electrodes from being influenced by other electric fields inside the neck.

In the color cathode ray tube apparatuses of a shadow-mask type, in particular, three electron guns are arranged in a delta or in-line configuration. If space Sg between electron beams from the electron guns is short, the three beams can be easily converged on the phosphor screen, so that power supply to the deflecting device can be reduced. Therefore, three conventional electron lenses arranged on the same plane are made perfectly to overlap one another, thereby forming one large-aperture electron lens. The best electron lens performance can be obtained with use of the large-aperture electron lens. FIG. 2 shows an example of the large-aperture electron lens. Although the core of each electron beam is small, in this example, the entire electron beam is not small enough. When three electron beams $B_R$, $B_G$, and $B_B$, arranged at spaces Sg, pass through common large-aperture electron lens LEL, outside beams $B_R$ and $B_B$ are excessively converged and focused if central beam $B_G$ is properly converged. Further, outside beams $B_R$ and $B_B$ suffer a substantial coma, so that spots $SP_R$, $SP_G$, and $SP_B$ of the three electron beams cannot be superposed, and outside spots $SP_R$ and $SP_B$ are distorted. The three electron beams can be properly converged to reduce the coma by shortening beam space Sg to some degree, depending on lens aperture D of electron lens LEL. In order to converge the three electron beams accurately on the phosphor screen, however, space Sg must be made very short. In the mechanical arrangement of an electron beam generating section, space Sg can be reduced only slightly.

FIG. 3 shows an electron gun disclosed in U.S. Pat. Nos. 3,448,316 or 4,528,476, as a means for solving the above problem. In this electron gun, the outside electron beam, out of three electron beams, is inclined at angle $\theta$ to a central beam as the beams are incident on electron lens LEL. The three electron beams intersect one another so as to pass through the central portion of lens LEL, whereby the convergence of the beams is suitably adjusted. Thereafter, the diffusing outside electron beams are deflected in opposite direction at angle $\phi$ by means of second lens LEL2, so that the three electron beams are converged on the phosphor screen. Thus, the convergence and focusing of the electron beams are improved in reliability. Nevertheless, the problem of the outside electron beams suffering the deflective aberration and coma is not solved yet.

A method for preventing over concentration of electron beams is described in Japanese Patent Application No. 62-186528. In order to converge the electron beams as shown in FIG. 4A, a plate member, as shown in FIG. 4B, is disposed on the side of an electron beam generating section, in the vicinity of a large-aperture electron lens of an electron gun. The plate member has a noncircular aperture common to the three electron beams. In this method, the three beams are rendered incident on the large-aperture electron lens without intersecting one another.

Since the plate member, however, has the common aperture for the passage of the three electron beams, according to the method described above, the electron beams cannot be properly focused if the convergence characteristic provided by the large-aperture electron lens is corrected. Accordingly, spots of the electron beams suffer a substantial coma. Thus, it is very difficult to control the three electron beams by means of the common large-aperture electron lens through which the electron beams pass.

SUMMARY OF THE INVENTION

The object of the present invention is to provide a color cathode ray tube apparatus, in which three electron beams are properly focused and converged on a screen by means of an electron gun having a common large-aperture electron lens through which the electron beams pass, whereby the function of the electron lens can be fulfilled.

A color cathode ray tube apparatus according to the present invention comprises: a vacuum envelope including a panel section, a funnel section, and a neck section, the panel section having an axis and a face plate, the front-view shape of which is substantially rectangular and which has an inner surface, and having a skirt extending from the peripheral edge of the face plate, the neck section being formed in a substantially cylindrical shape, the funnel section being continuous with the neck section; a phosphor screen formed on the inner surface of the face plate; a shadow mask arranged inside the panel section so as to face the phosphor screen on the face plate; an in-line electron gun assembly housed in the neck section, the assembly having an electron beam forming unit for generating, controlling, and accelerating three electron beams, including one central electron beam and two outside electron beams, and a main lens unit for converging and focusing the three electron beams; and a deflecting device for vertically and horizontally deflecting the electron beams emitted from the electron gun assembly. The color cathode ray tube apparatus of the invention is characterized in that the main electron lens unit includes a large-aperture electron lens serving in common for the three electron beams, and individual electron lenses serving individually for the three electron beams so that the outside electron beams produce an aberration in a direction such that the component of an aberration produced by the large-aperture electron lens is canceled, within the region of the large-aperture electron lens, the respective central axes of the three electron beams incident on the large-aperture electron lens are substantially parallel to one another, and means for forming individual electron beams diffusing relatively more strongly in the horizontal direction than in the vertical direction is provided on the side of the electron beam forming unit with respect to the large-aperture electron lens.

According to the color cathode ray tube apparatus of the present invention, the electron beams are properly landed on the screen, so that the picture quality is greatly improved.

DETAILED DESCRIPTION OF THE PREFERRED EMBODIMENTS

Preferred embodiments of the present invention will now be described in detail with reference to the accompanying drawings.

Figure 1:
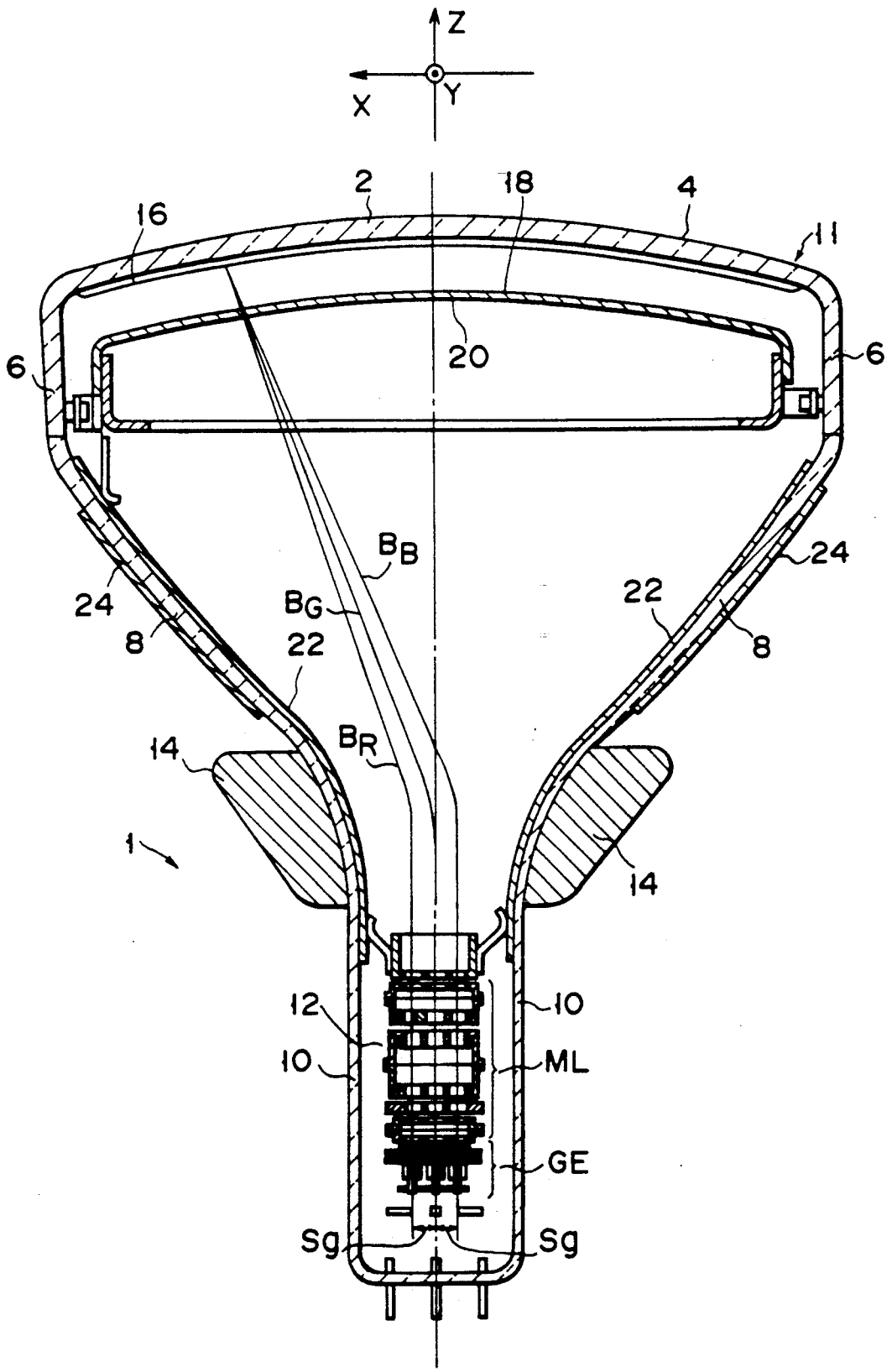
PRIOR ART FIG. 1
FIG. 1 shows a sectional view of a prior art color cathode ray tube apparatus.
Figure 2:
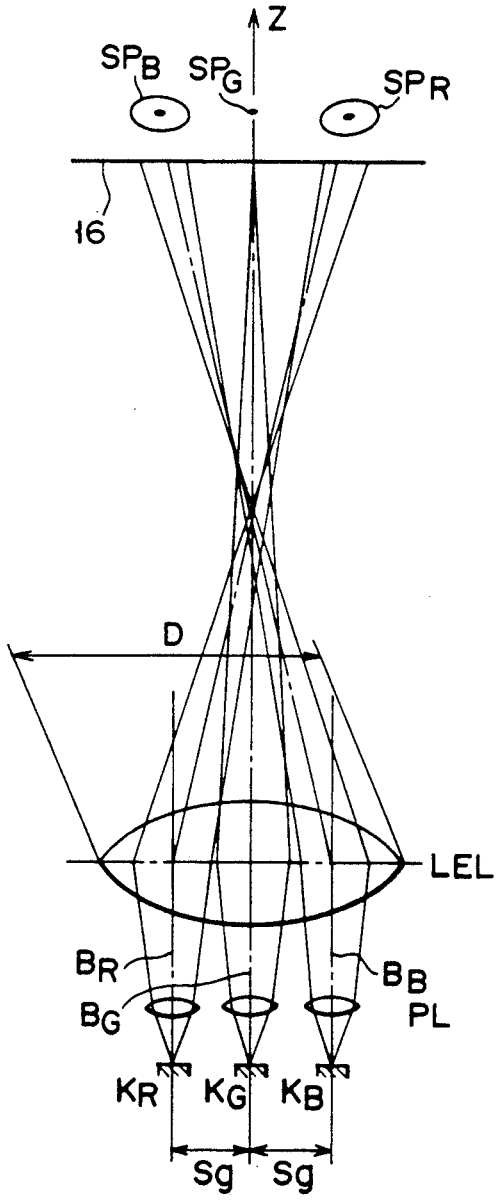
PRIOR ART FIG. 2
FIG. 2 is a top view showing the state of electron beams in an example of the prior art color cathode ray tube apparatus.
Figure 3:
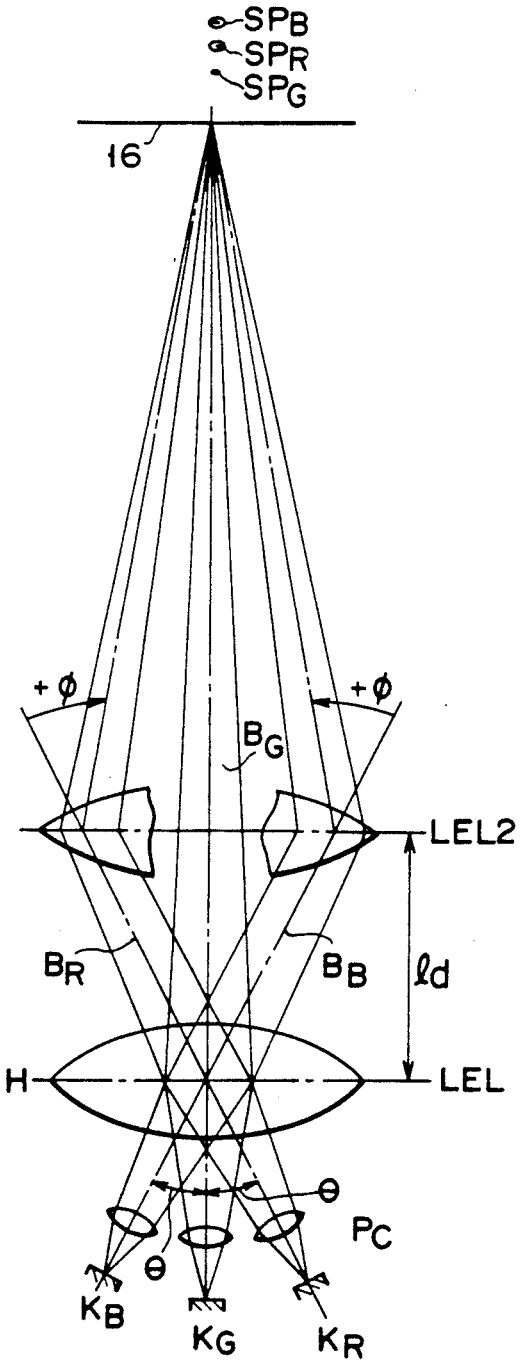
PRIOR ART FIG. 3
FIG. 3 is a top view showing the state of electron beams in another example of the prior art color cathode ray tube apparatus.
Figure 4A:
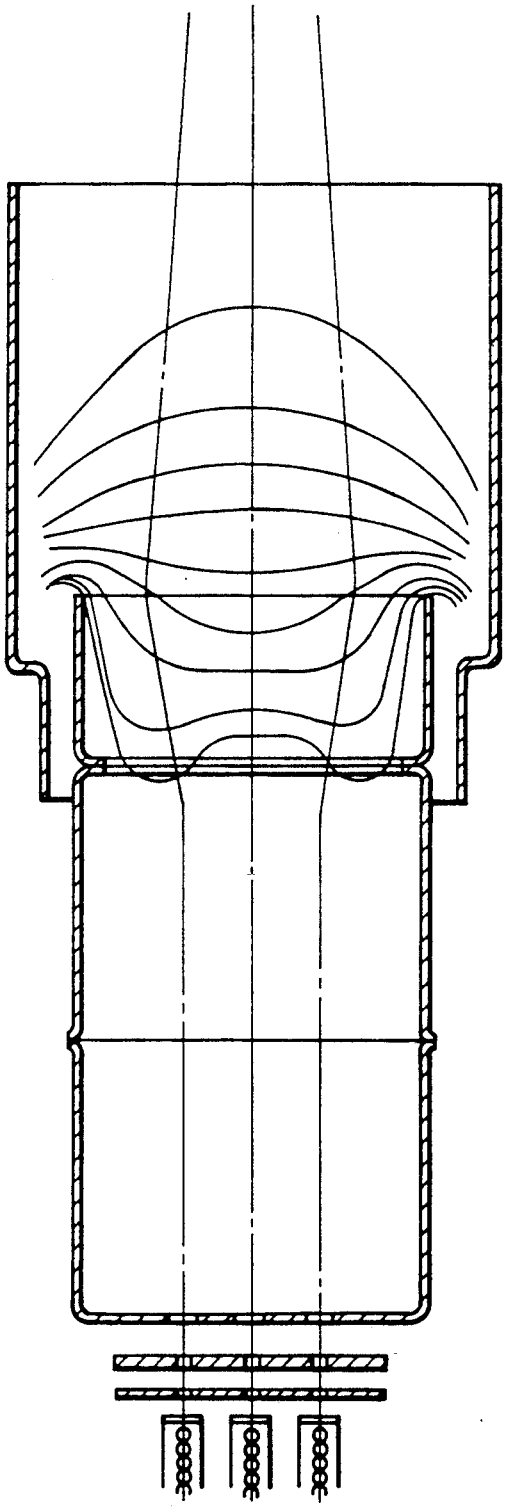
PRIOR ART FIG. 4A
FIG. 4A is a top view showing the state of a magnetic field inside a prior art electron gun.
Figure 4B:
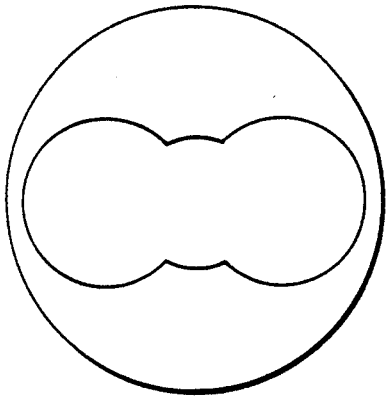
PRIOR ART FIG. 4B
FIG. 4B is a plan view of a prior art auxiliary.
Figure 5:
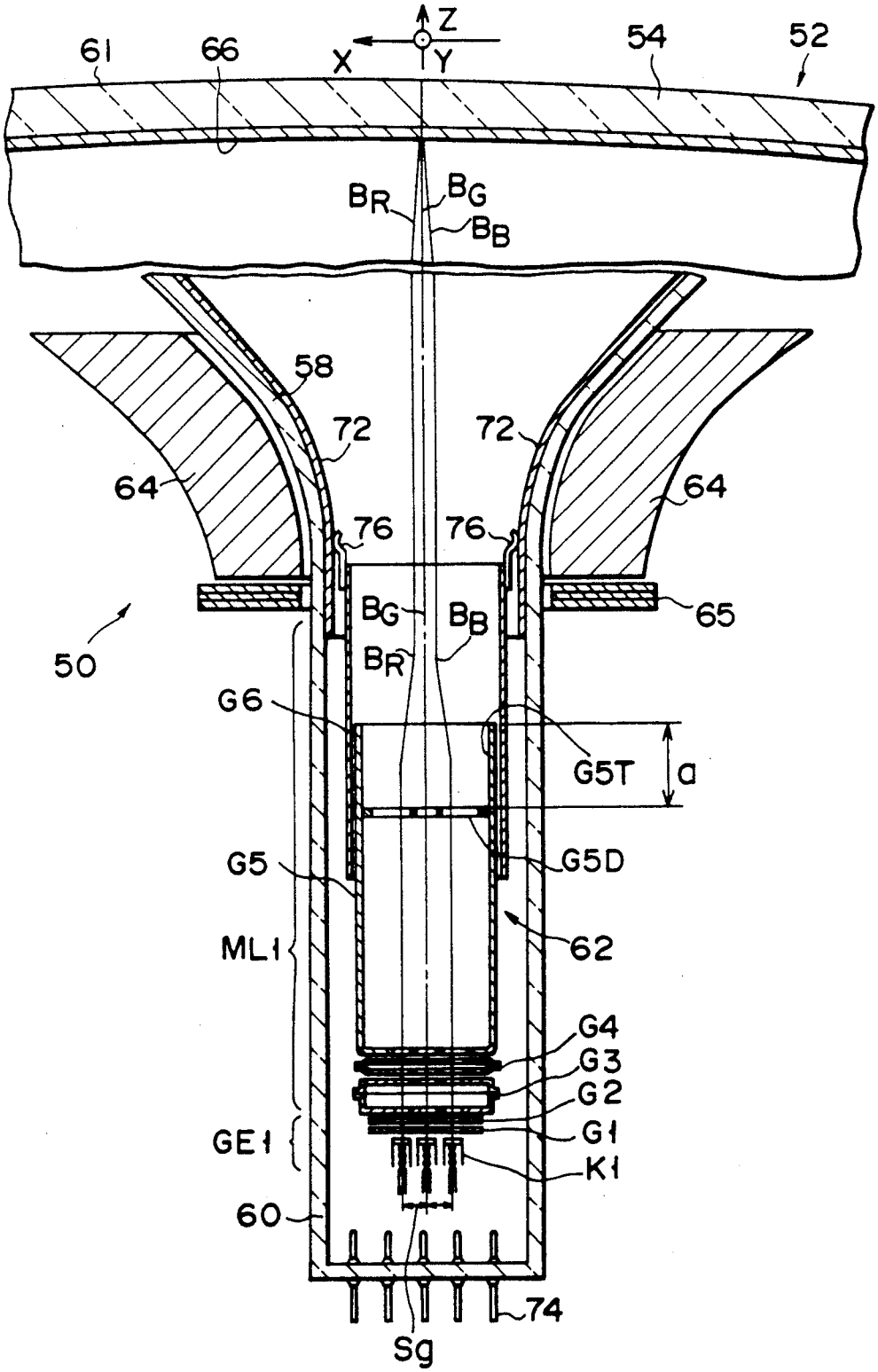
FIG. 5 is a sectional view showing part of a color cathode ray tube apparatus according to a first embodiment of the present invention.

FIG. 5 shows part of a color cathode ray tube apparatus according to a first embodiment of the present invention. Color cathode ray tube apparatus 50 comprises envelope 61 which includes panel section 52, funnel section 58 bonded to panel section 52, and neck section 60 continuous with funnel section 58. Panel section 52 has face plate 54, which is substantially rectangular in shape, and a skirt (not shown) extending from the peripheral edge of plate 54. The inside of the color cathode ray tube is kept at a vacuum by sections 52, 58 and 60. Electron gun assembly 62 is used for emitting three electron beams $B_R$, $B_G$, and $B_B$ and is housed inside neck section 60. Deflecting device 64, which includes horizontal and vertical deflecting coils, is mounted on the outer peripheral surfaces of funnel and neck sections 58 and 60. The horizontal and vertical deflecting coils serve to generate magnetic fields in order to deflect electron beams $B_R$, $B_G$, and $B_B$ horizontally and vertically, respectively. Multipolar magnet 65 for adjusting the tracks of the electron beams is mounted on neck section 60. Phosphor screen 66 is formed on the inner surface of face plate 54 of panel section 52. Inside the tube, a substantially rectangular shadow mask (not shown) is arranged opposite screen 66 so that a predetermined space is kept between the mask and face plate 54. The mask, which is formed of a metal sheet, has a number of perforations. Internal conductor film 72 is applied to the inner wall surface of part of envelope 61 between funnel and neck sections 58 and 60. A plurality of stem pins 74 is attached to the end portion of neck section 60.

Electron gun assembly 62 inside neck section 60 includes three cathodes K1 for generating electrons, planar first grid G1, planar second grid G2, and third, fourth, fifth, and sixth grids G3, G4, G5, and G6. Sixth grid G6 is provided with valve spacer 76 for supporting assembly 62. Electron gun assembly 62 is connected to stem pins 74 (connection is not shown in FIG. 5).

Figure 6:
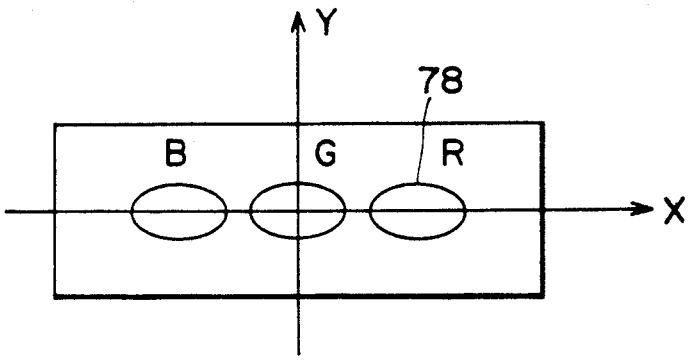
FIG. 6 is a plan view showing the configuration of grid G3, G4, or G5.
Figure 7:
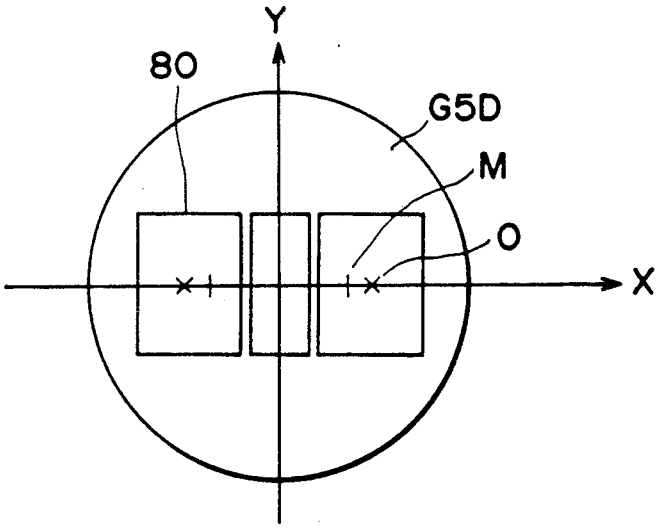
FIG. 7 is a plan view showing the configuration of auxiliary electrode G5D.

Each cathode K1 has a heater (not shown) therein. First and second grids G1 and G2 are each provided with three small beam apertures corresponding to cathodes K1. This portion constitutes electron beam forming unit GE1. Third, fourth, and fifth grids G3, G4, and G5 are each provided with three relatively large beam apertures 78, as shown in FIG. 6. FIG. 6 shows beam apertures 78 of fourth grid G4, or of third or fifth grid G3 or G5, as viewed from the fourth-grid side. Each aperture 78 is substantially in the form of an ellipse whose diameter in the vertical direction (Y-direction) is shorter than its diameter in the horizontal direction (X-direction). Auxiliary electrode G5D, for use as means for correcting the convergence and focusing of the three electron beams, is disposed inside that portion of fifth grid G5 on the sixth-grid side. As shown in FIG. 7, electrode G5D has three rectangular electron beam apertures 80. The auxiliary electrode is located at predetermined distance a from that end of fifth grid G5 on the sixth-grid side. Sixth grid G6 is a substantially cylindrical electrode which partially covers and surrounds fifth grid G5 in the form of a cylindrical electrode. A large-aperture cylindrical electron lens is practically formed between sixth grid G6 and the large beam apertures of fifth grid G5. Valve spacer 76, which is attached to the outer periphery of the distal end portion of sixth grid G6, is in contact with conductor film 72 applied to the inner surfaces of funnel and neck sections 58 and 60. In this arrangement, high voltage is supplied from an anode terminal attached to funnel section 58.

All the electrodes of electron gun assembly 62 except sixth grid G6 are supplied with voltage from stem pins 74. A cutoff voltage of about 150 V, involving a video signal, is applied to cathodes K1. First grid G1 is at an earth potential. Voltages of 500 V to 1 kV, 5 kV to 10 kV, 500 V to 10 kV, 5 kV to 10 kV, and 25 kV to 35 kV (high anode voltage) are applied to second, third, fourth, fifth, and sixth grids G2, G3, G4, G5, and G6, respectively.

Figure 8:
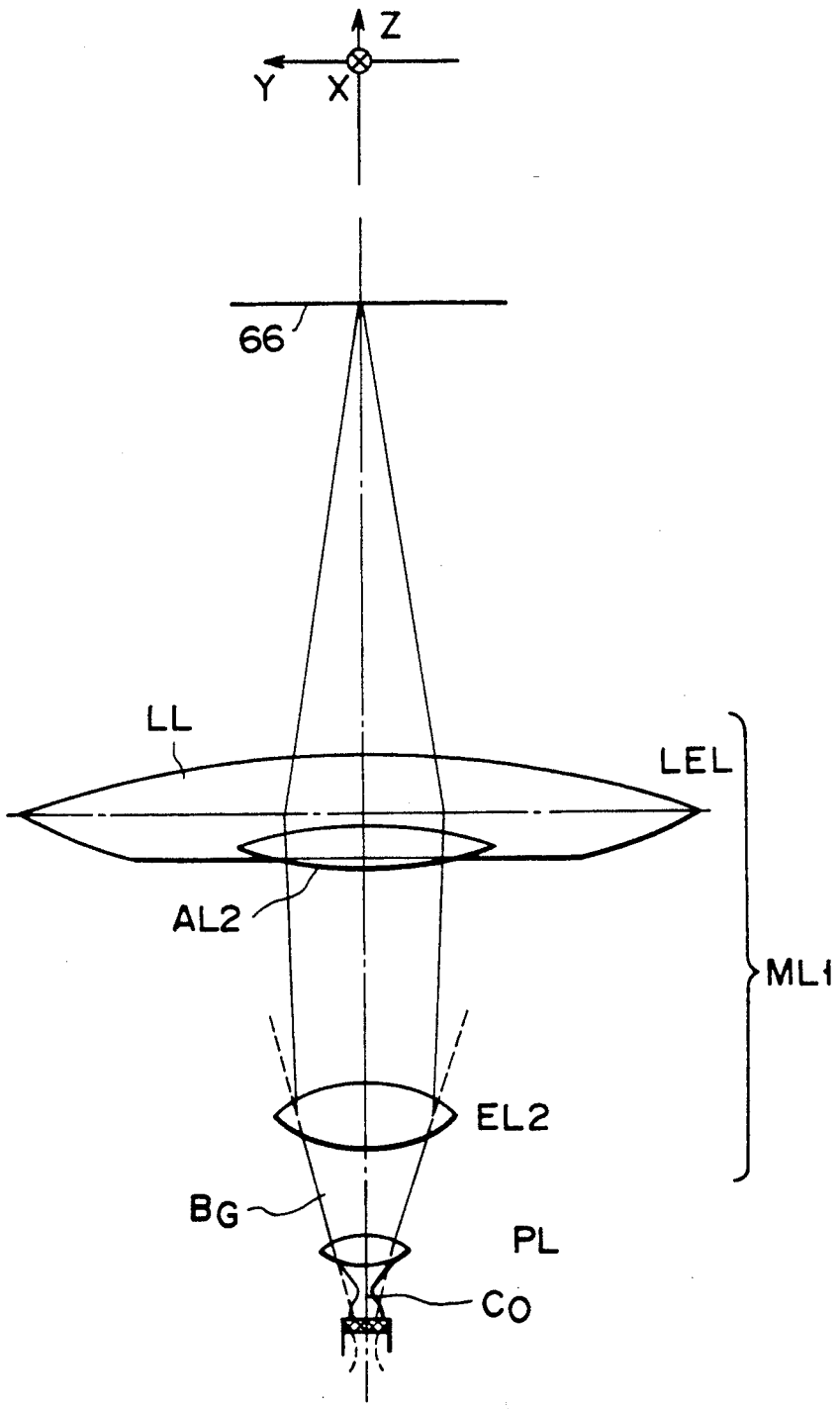
FIG. 8 is an optical diagram on a Y-Z plane, showing the state of an electron beam inside an electron gun according to the present invention.
Figures 9, 10:
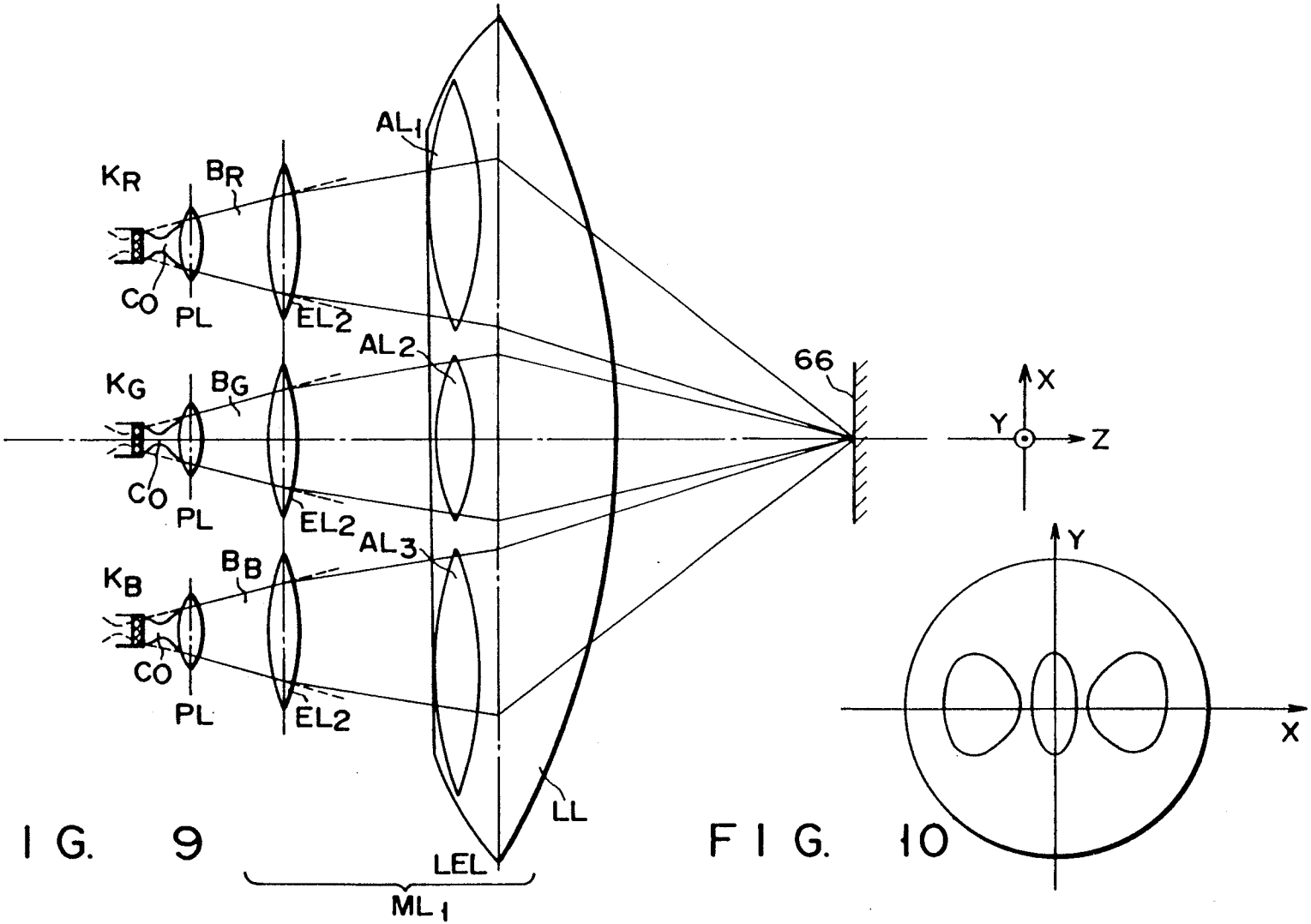
FIG. 9 is an optical diagram on an X-Z plane, showing the state of electron beams inside the electron gun according to the present invention.
FIG. 10 is a plan view showing a modification of the configuration of auxiliary electrode G5D.

FIGS. 8 and 9 optically equivalently show a state of the electron beams. In this state, three electron beams $B_R$, $B_G$, and $B_B$ are generated from cathodes K1 in accordance with a modulation signal. Each of these electron beams is formed into crossover CO by means of first and second grids G1 and G2. Then, each electron beam is slightly focused into an imaginary crossover by means of prefocus lens PL, which is formed of second and third grids G2 and G3. Electron beams $B_R$, $B_G$, and $B_B$ are diffused as they are rendered incident on third grid G3. The electron beams, incident on third grid G3, are focused by means of main electron lens unit ML1, which is formed of third to sixth grids G3 to G6. Outside beams $B_R$ and $B_B$ are also converged by lens unit ML1. Thus, electron beams $B_R$, $B_G$, and $B_B$ are landed on phosphor screen 66.

The lens effect of main electron lens unit ML1 will now be described in detail. Electron beams $B_R$, $B_G$, and $B_B$, each formed into the imaginary crossover, are slightly focused by means of individual weak unipotential lenses EL2 (second electron lenses), which are formed of third, fourth, and fifth grids G3, G4, and G5. Since fourth grid G4 has substantially elliptic apertures, as mentioned before, lenses EL2 are formed as so-called astigmatic lenses whose focusing force is stronger in the vertical direction than in the horizontal direction. Accordingly, electron beams $B_R$, $B_G$, and $B_B$ are focused stronger in the vertical direction than in the horizontal direction. Thereafter, the electron beams are rendered incident on large-aperture electron lens LEL.

Large-aperture electron lens LEL is formed of fifth and sixth grids G5 and G6. Since the application of high voltage from the side of sixth grid G6 is controlled by electrode G5D, however, distal end portion G5T (common aperture for the three beams) and the cylinder (common aperture for the three beams) of sixth grid G6 constitute one large electron lens LL. Within the region of this lens, moreover, three astigmatic lenses AL1, AL2, and AL3 are formed on the low-voltage side.

In electron gun assembly 62, the power of electron lens LL is first set so that the three electron beams are accurately converged on phosphor screen 66. Then, the respective powers of three astigmatic lenses AL1, AL2, and AL3 are set in order that the three beams are accurately focused on screen 66. In this case, outside apertures 80 of electrode G5D are made wider than the central aperture, as shown in FIG. 7, so that lenses AL1 and AL3 are less powerful than lens AL2. Thus, focusing differences between two outside beams and a central beam, produced by electron lens LL, are corrected. Position 0 of the center of each outside aperture of electrode G5D is situated outside central axis M of its corresponding outside apertures of grids G1, G2, G3, and G4, without being aligned therewith. In a horizontal plane (X-Z plane), therefore, the outside beams pass near the respective central axes of their corresponding astigmatic lenses AL1 and AL3, so that comae are produced. Since the outside beams are subjected to a coma produced by electron lens LL, however, the comae of the outside beams are canceled by the lenses. Thus, spots of the outside beams formed on the phosphor screen enjoy a satisfactory configuration.

The care of the present invention lies in that the state of focus of the electron beams, focused in the vertical direction (Y-Z direction) by the large-aperture electron lens, is different from the state of focus in the horizontal direction (X-Z direction). This difference occurs because the focusing force of the astigmatic lenses in the vertical direction is weaker than the focusing force in the horizontal direction, since the apertures of electrode G5D are vertically elongated. In this case, the vertical diameter of each electron beam passing through the large-aperture electron lens is shorter than its horizontal diameter. Thus, in the region where the magnetic fields are generated by means of the deflecting device, the vertical beam diameter is shorter than the horizontal diameter. In this state, the electron beams are landed on the phosphor screen. As the change of the vertical diameter of the electron beams affected by the deflecting device is larger than the change of the horizontal diameter thereof, the electron beams cannot be easily influenced by the deflecting magnetic fields generated by the deflecting device. In consequence, spots of the electron beams landed on the phosphor screen enjoy a satisfactory configuration, so that the color cathode ray tube can produce pictures of very high quality.

In the arrangement described above, fifth grid G5 has the three rectangular apertures. Alternatively, however, grid G5 may be formed with three substantially elliptic apertures, as shown in FIG. 10. Also, a magnetic field correcting element for correcting the magnetic fields generated by the deflecting device may be attached to the distal end portion of sixth grid G6.

The following is a description of an example of specific dimensions used according to the first embodiment.

| | |
|---|---|
| Cathode spacing: | Sg = 4.92 mm |
| Aperture diameter: | |
| First grid G1: | 0.62 mm |

-continued

| | |
|---|---|
| Second grid G2: | 0.62 mm |
| Third grid G3: | 4.52 mm |
| Fourth grid G4: | 4.52 mm |
| Electrode G5D of fifth grid G5: | 4.52 mm |
| Electrode G5T of fifth grid G5: | 25.0 mm |
| Sixth grid G6: | 28.0 mm |
| Electrode length: | |
| Third grid G3: | 6.2 mm |
| Fourth grid G4: | 2.0 mm |
| Fifth grid G5: | 55.0 mm |
| Sixth grid G6: | 40.0 mm |
| Electrode spacing: | |
| Between grids G1 and G2: | 0.35 mm |
| Between grids G3 and G3: | 1.2 mm |
| Between grids G3 and G4: | 0.6 mm |
| Between grids G4 and G5: | 0.6 mm |
| Space between G5D and G5T: | a = 12 to 17 mm |

Figure 11:
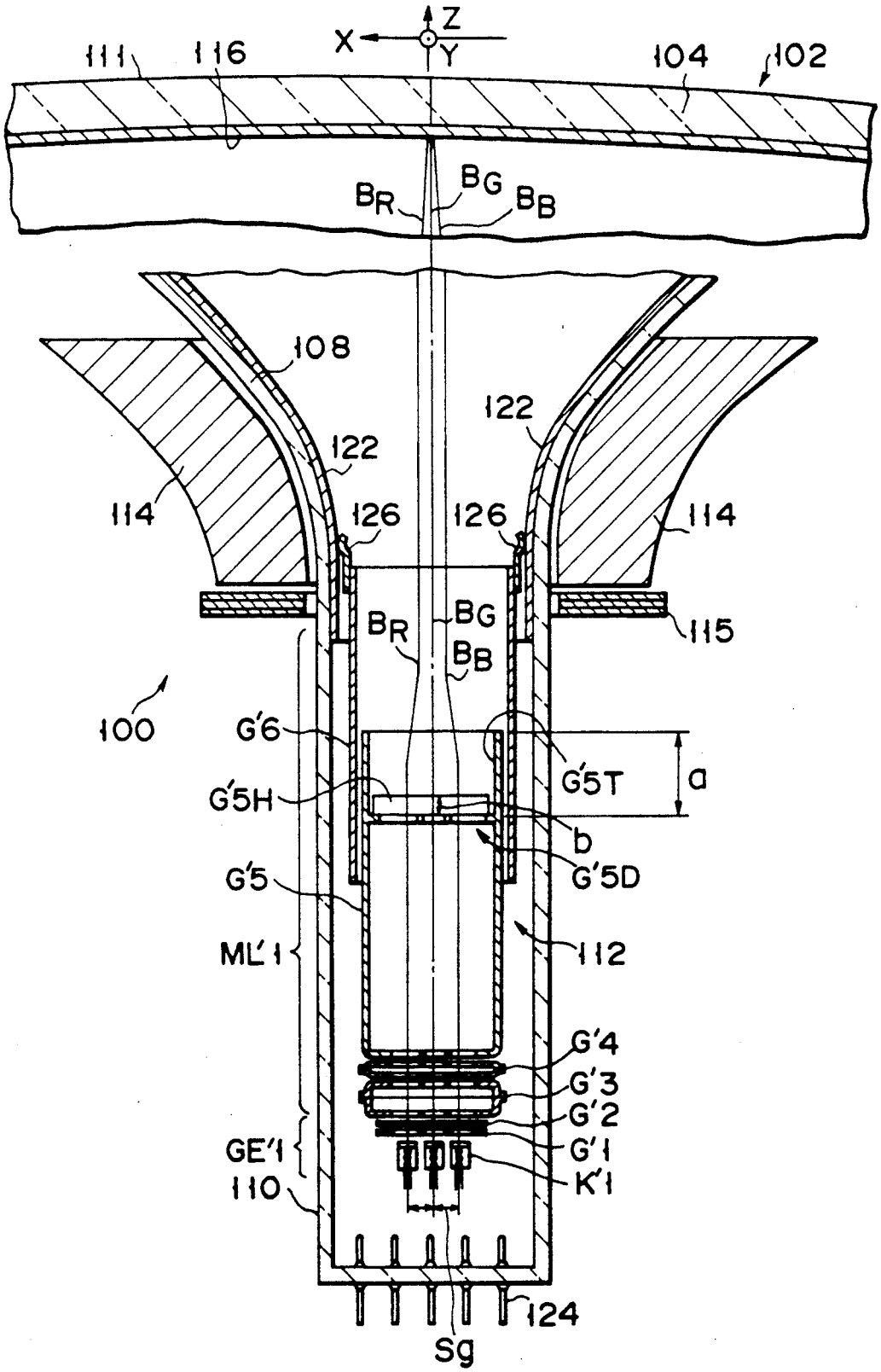
FIG. 11 is a sectional view showing part of a color cathode ray tube apparatus according to a second embodiment of the present invention.

FIG. 11 shows part of a color cathode ray tube apparatus according to a second embodiment of the present invention. Color cathode ray tube apparatus 100 comprises envelope 111 which includes panel section 102, funnel section 108 bonded to panel section 102, and neck section 110 continuous with funnel section 108. Panel section 102 has face plate 104 which is substantially rectangular in shape and a skirt (not shown) extending from the peripheral edge of plate 104. The inside of the color cathode ray tube is kept at a vacuum by sections 102, 108 and 110. Electron gun assembly 112 is used for emitting three electron beams $B_R$, $B_G$, and $B_B$ and is housed inside neck section 110. Deflecting device 114, which includes horizontal and vertical deflecting coils, is mounted on the outer peripheral surfaces of funnel and neck sections 108 and 110. The horizontal and vertical deflecting coils serve to generate magnetic fields in order to deflect electron beams $B_R$, $B_G$, and $B_B$ horizontally and vertically, respectively. Multipolar magnet 115 for adjusting the tracks of the electron beams is mounted on neck section 110. Phosphor screen 116 is formed on the inner surface of face plate 104 of panel section 102. Inside the tube, a substantially rectangular shadow mask (not shown) is arranged opposite screen 116 so that a predetermined space is kept between the mask and face plate 104. The mask, which is formed of a metal sheet, has a number of perforations. Internal conductor film 122 is applied to the inner wall surface of part of envelope 111 between funnel and neck sections 108 and 110. A plurality of stem pins 124 is attached to the end portion of neck section 110.

Electron gun assembly 112 inside neck section 110 includes three cathodes K'1 for generating electrons, planar first grid G'1, planar second grid G'2, and third, fourth, fifth, and sixth grids G'3, G'4, G'5, and G'6. Sixth grid G'6 is provided with valve spacer 126 for supporting assembly 112. Electron gun assembly 112 is connected to stem pins 124 (connection is not shown in FIG. 11).

Figure 12:
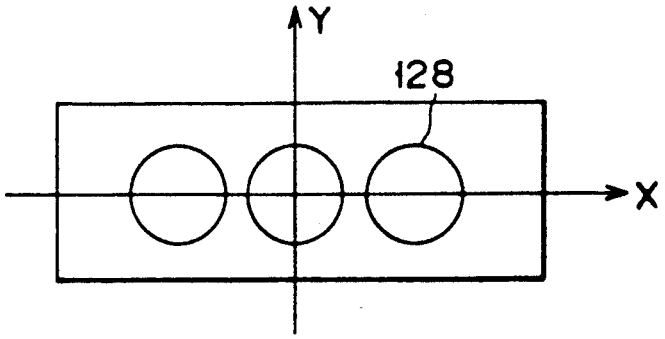
FIG. 12 is a plan view showing the configuration of grid G'3, G'4, or G'5.

Each cathode K'1 has a heater (not shown) therein. First and second grids G'1 and G'2 are each provided with three small beam apertures corresponding to cathodes K'1. This portion constitutes electron beam forming unit GE'1. Third, fourth, and fifth grids G'3, G'4, and G'5 are each provided with three relatively large beam apertures 128 different from those of the first embodiment, as shown in FIG. 12. FIG. 12 shows beam apertures 128 of fourth grid G'4, or of third or fifth grid G'3 or G'5, as viewed from the fourth-grid side. Each aperture 128 is substantially in the form of a circle whose diameter in the vertical direction (Y-direction) is equivalent to its diameter in the horizontal direction (X-direction). Auxiliary electrode G'5D, shown in FIGS. 13A and 13B, for use as means for correcting the convergence and focusing of the three electron beams, is disposed inside that portion of fifth grid G'5 on the side nearest sixth-grid G'6. Also shown in FIGS. 13A and 13B, electrode G'5D has three rectangular electron beam apertures 130. A pair of electric field control electrodes G'5H is arranged individually above and below apertures 130 of auxiliary electrode G'5D. Each electrode G'5H projects for length b. Auxiliary electrode G'5D is located at predetermined distance a from that end of fifth grid G'5 on the side nearest sixth-grid G'6. Sixth grid G'6 is a substantially cylindrical electrode which partially covers and surrounds fifth grid G'5 in the form of a cylindrical electrode. A large-aperture cylindrical electron lens is practically formed between sixth grid G'6 and the large beam apertures of fifth grid G'5. Valve spacer 126, which is attached to the outer periphery of the distal end portion of sixth grid G'6, is in contact with conductor film 122 applied to the inner surfaces of funnel and neck sections 108 and 110. In this arrangement, high voltage is supplied from an anode terminal attached to funnel section 108.

All the electrodes of electron gun assembly 112 except sixth grid G'6 are supplied with voltage from stem pins 124. A cutoff voltage of about 150 V, involving a video signal, is applied to cathodes K'1. First grid G'1 is at an earth potential. Voltages of 500 V to 1 kV, 5 kV to 10 kV, 500 V to 10 kV, 5 kV to 10 kV, and 25 kV to 35 kV (high anode voltage) are applied to second, third, fourth, fifth, and sixth grids G'2, G'3, G'4, G'5, and G'6, respectively.

FIGS. 8 and 9 show a such state of the electron beams. Three electron beams $B_R$, $B_G$, and $B_B$ are generated from cathodes K'1 (FIG. 11) in accordance with a modulation signal. As in the case of the first embodiment, each of these electron beams is formed into crossover CO by means of first and second grids. Then, each electron beam is slightly focused into an imaginary crossover by means of prefocus lens PL, which is formed of second and third grids. Electron beams $B_R$, $B_G$, and $B_B$ are diffused as they are rendered incident on the third grid. The electron beams, incident on the third grid, are focused by means of main electron lens unit ML1, which is formed of third to fifth grids. Electron beams $B_R$, $B_G$, and $B_B$ are rendered incident on large-aperture electron lens LEL.

As shown in FIGS. 8, 9, 11, 13*a* and 13*b*, large-aperture electron lens LEL is formed of fifth and sixth grids G'5 and G'6. Since the application of high voltage from the side of sixth grid G'6 is controlled by electrode G'5D, however, distal end portion G'5T (common aperture for the three beams) and the cylinder (common aperture for the three beams) of sixth grid G'6 constitute one large electron lens LL. Within the region of this lens, moreover, three astigmatic lenses AL1, AL2, and AL3 are formed on the low-voltage side.

Figure 13A:
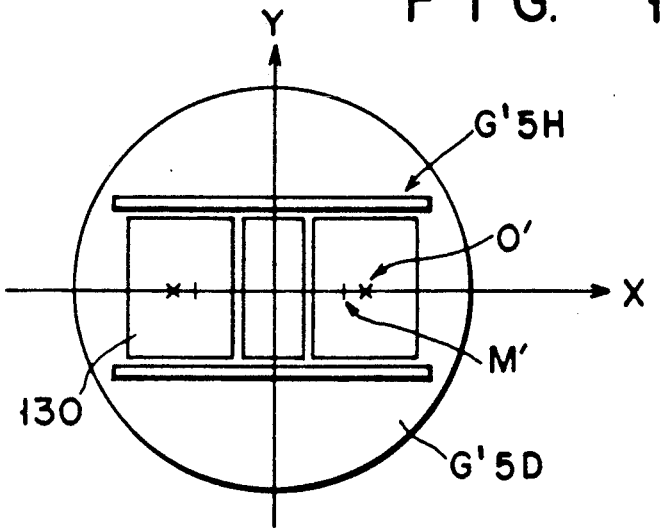
FIG. 13A is a plan view showing the configuration of auxiliary electrode G'5D.
Figure 13B:
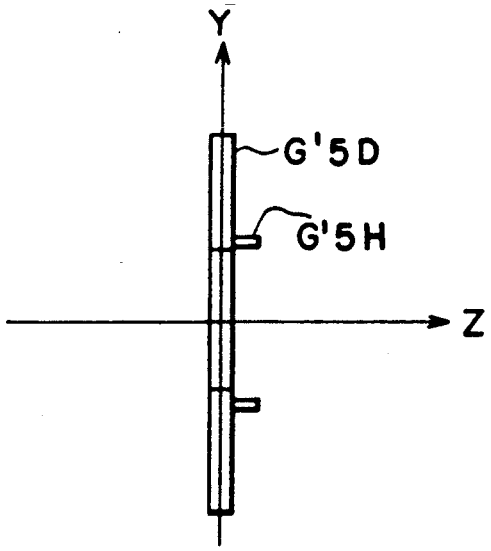
FIG. 13B is a side view showing the configuration of auxiliary electrode G'5D.

In electron gun assembly 112, the power of electron lens LL is first set so that the three electron beams are accurately converged on phosphor screen 116. Then, the respective powers of three astigmatic lenses AL1, AL2, and AL3 are set in order that the three beams are accurately focused on screen 116. In this case, outside apertures 130 of electrode G'5D are made wider than the central aperture, as shown in FIG. 13A, so that lenses AL1 and AL3 are less powerful than lens AL2. Thus, focus differences between two outside beams and a central beam, produced by electron lens LL', are corrected. In contrast with the case of the first embodiment, a pair of electric field control electrodes G'5H are arranged individually above and below the three electron beam apertures of auxiliary electrode G'5D inside fifth grid G5. Electrodes G'5H serve to control focusing electric fields on the low-voltage side of large-aperture electron lens LEL, which is formed of fifth and sixth grids G'5 and G'6. Thus, the three electron beams are strongly focused in the vertical direction. Position O' of the center of each outside aperture of electrode G'5D is situated outside central axis M'of its corresponding outside apertures of grids G'1, G'2, G'3, and G'4, without being aligned therewith. In the horizontal plane (X-Z plane), therefore, the outside beams pass near the respective central axes of their corresponding astigmatic lenses AL1 and AL3, so that comae are produced. Since the outside beams are subjected to a coma produced by electron lens LL, however, the comae of the outside beams are canceled by the lenses. Thus, spots of the outside beams formed on the phosphor screen enjoy a satisfactory configuration. In the first embodiment, the degree of vertical focus of the electron beams by large-aperture electron lens LEL is different from the degree of horizontal focus. When the beams are focused in the vertical direction, the characteristic of lens LEL' cannot be fully utilized, and the vertical diameter of the spots of the electron beams landed on the phosphor screen cannot be reduced very much. In this second embodiment, therefore, the focusing electric fields on the low-voltage side of lens LEL, which is formed of fifth and sixth grids G'5 and G'6, are controlled by means of electrodes G'5H. Accordingly, the three electron beams are strongly focused in the vertical direction. Since the outside electron beams are strongly focused by the large-aperture electron lens formed of fifth and sixth grids G'5 and G'6, the beams are properly focused in the vertical direction, as well as in the horizontal direction.

In the second embodiment, as described above, electric field control electrodes G'5H are mounted on auxiliary electrode G'5D inside fifth grid G'5, and the vertically focusing capability of the electron beams is higher than in the first embodiment. Thus, the vertical resolution of a picture projected on the phosphor screen is improved.

Figure 14:
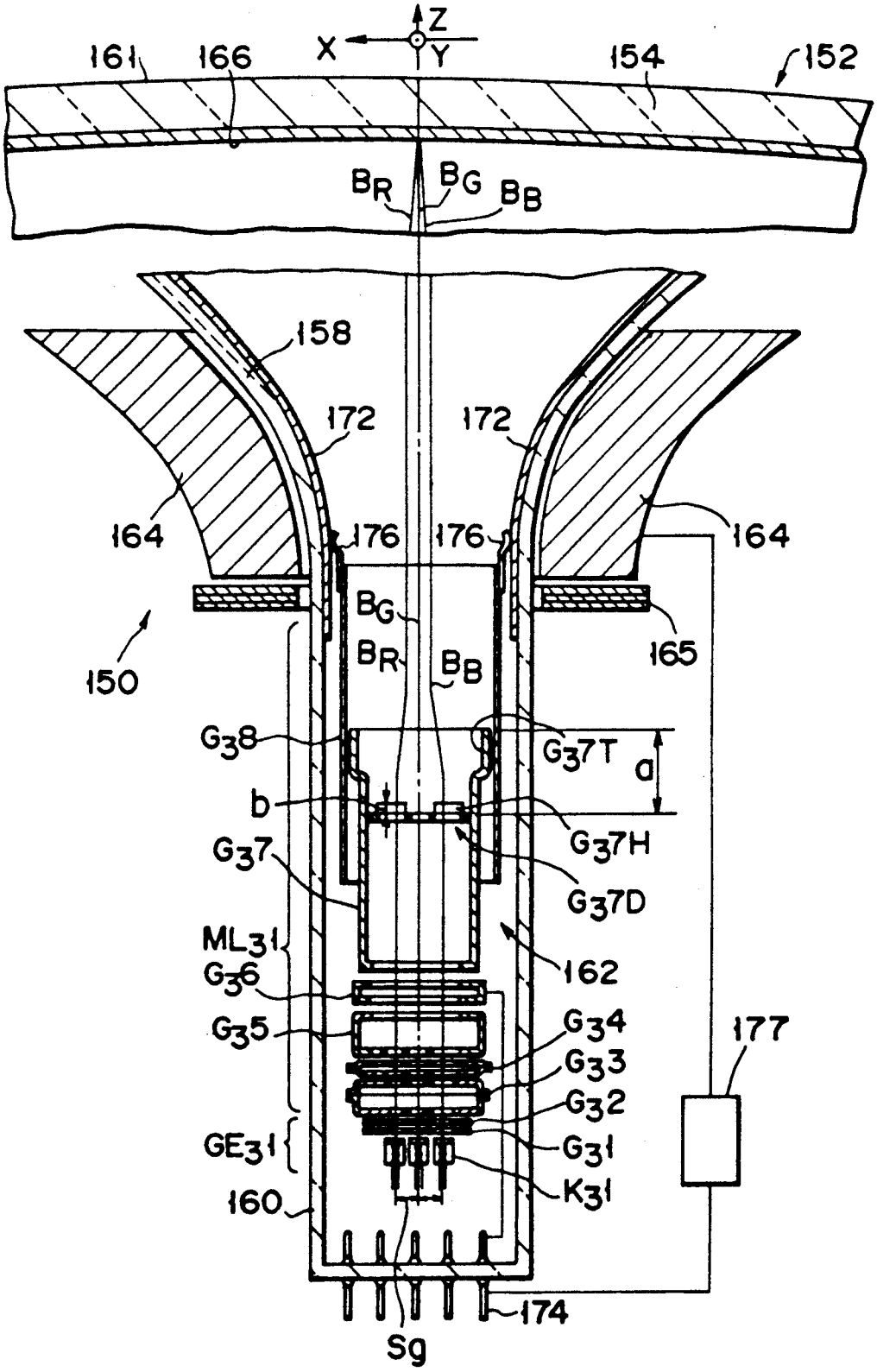
FIG. 14 is a sectional view showing part of a color cathode ray tube apparatus according to a third embodiment of the present invention.

FIG. 14 shows part of a color cathode ray tube apparatus according to a third embodiment of the present invention. Color cathode ray tube apparatus 150 comprises envelope 161 which includes panel section 152, funnel section 158 bonded to panel section 152, and neck section 160 continuous with funnel section 158. Panel section 152 has substantially rectangular face plate 154 and a skirt (not shown) extending from the peripheral edge of plate 154. The inside of the color cathode ray tube is kept at a vacuum by sections 152, 158 and 160. Electron gun assembly 162 is used for emitting three electron beams $B_R$, $B_G$, and $B_B$ and is housed inside neck section 160. Deflecting device 164, which includes horizontal and vertical deflecting coils, is mounted on the outer peripheral surfaces of funnel and neck sections 158 and 160. The horizontal and vertical deflecting coils serve to generate magnetic fields in order to deflect electron beams $B_R$, $B_G$, and $B_B$ horizontally and vertically, respectively. Multipolar magnet 165 for adjusting the tracks of the electron beams is mounted on neck section 160. Phosphor screen 166 is formed on the inner surface of face plate 154 of panel section 152. Inside the tube, a substantially rectangular shadow mask (not shown) is arranged opposite screen 166 so that a predetermined space is kept between the mask and face plate 154. The mask, which is formed of a metal sheet, has a number of perforations. Internal conductor film 172 is applied to the inner wall surface of part of envelope 161 between funnel and neck sections 158 and 160. A plurality of stem pins 174 is attached to the end portion of neck section 160.

Electron gun assembly 162 inside neck section 160 includes three cathodes $K_31$ for generating electrons, planar first grid $G_31$, planar second grid $G_32$, and third, fourth, fifth, sixth, seventh, and eighth grids $G_33$, $G_34$, $G_35$, $G_36$, $G_37$, and $G_38$. Eighth grid $G_38$ is provided with valve spacer 176 for supporting assembly 162. Electron gun assembly 162 is connected to stem pins 174 (connection is not shown in FIG. 14). Further, correction circuit 177 is connected to sixth grid G36 via stem pins 174. Circuit 177 supplies a voltage which changes in a parabolic configuration in synchronism with a current supplied to the deflecting device.

Figure 15:
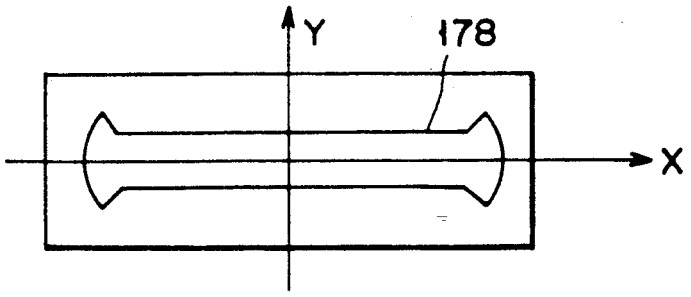
FIG. 15 is a plan view showing the configuration of grid $G_35$, $G_36$, $G_37$, or $G_44$.
Figure 16:
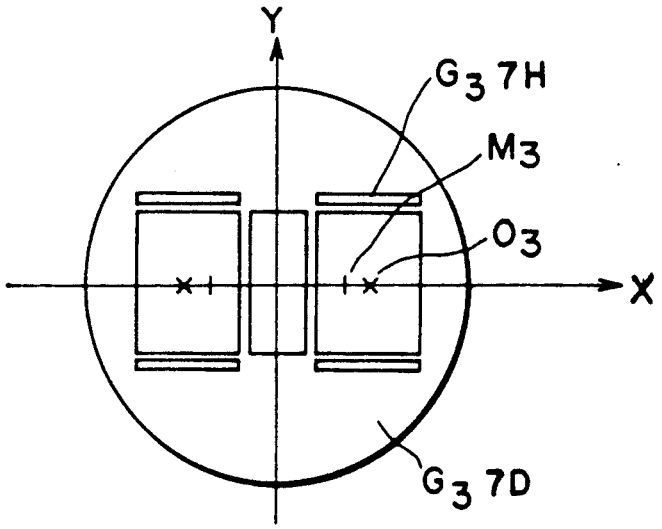
FIG. 16 is a plan view showing the configuration of auxiliary electrode $G_37D$.

Each cathode $K_31$ has a heater (not shown) therein. First and second grids $G_31$ and $G_32$ are each provided with three small beam apertures corresponding to cathodes $K_31$. This portion constitutes electron beam forming unit $GE_31$. Third, fourth, and fifth grids $G_33$, $G_34$, and $G_35$ are each provided with three relatively large beam apertures 128. As in the second embodiment, apertures 128 of third grid $G_33$, fourth grid $G_34$, or fifth grid $G_35$ as viewed from the fourth-grid side are shown in FIG. 12. Each aperture 128 is substantially in the form of a circle whose diameter in the vertical direction (Y-direction) is equal to its diameter in the horizontal direction (X-direction). Unipotential lenses, which are formed of third, fourth, and fifth grids $G_33$, $G_34$, and $G_35$, have equal focusing forces in the vertical and horizontal directions. FIG. 15 shows beam aperture 178 of sixth grid $G_36$, or of fifth or seventh grid $G_35$ or $G_37$, as viewed from the sixth-grid side. Aperture 178 is a common aperture for the three electron beams, and its horizontal diameter is about five times as long as its vertical diameter or more. Unipotential lenses, which are formed of fifth, sixth, and seventh grids $G_35$, $G_36$, and $G_37$, are so-called parallel plate lenses which focus the electron beams only in the vertical direction, without substantially focusing the beams in the horizontal direction. Therefore, the electron beams incident on a large-aperture cylindrical electron lens formed of seventh and eighth grids $G_37$ and $G_38$ are diffused more strongly in the horizontal direction than in the vertical direction. A substantially cylindrical electrode, having a large beam aperture $G_37T$, is provided on the eighth-grid side of seventh grid $G_37$. Inside seventh grid $G_37$, auxiliary electrode $G_37D$, having three vertically elongated electron beam apertures, is located at distance a from that end of seventh grid $G_37$ on the eighth-grid side. Electrode $G_37D$, which is shown in FIG. 16, includes two pairs of electric field control electrodes $G_37H$ which project for length b, from the regions above and below the outside beam apertures toward eighth grid $G_38$. Eighth grid $G_38$ is a substantially cylindrical electrode which partially covers and surrounds seventh grid $G_37$ in the form of a cylindrical electrode. The large-aperture cylindrical electron lens is practically formed between eighth grid $G_38$ and the large beam apertures of seventh grid $G_37$. Valve spacer 176, which is attached to the outer periphery of the distal end portion of eighth grid $G_38$, is in contact with conductor film 172 applied to the inner surfaces of funnel and neck sections 158 and 160. In this arrangement, high voltage is supplied from an anode terminal attached to funnel section 158.

All the electrodes of electron gun assembly 162 except eighth grid $G_38$ are supplied with voltage from stem pins 174. A cutoff voltage of about 150 V, involving a video signal is applied to cathodes $K_31$. First grid $G_31$ is at an earth potential. Voltages of 500 V to 1 kV, 5 kV to 10 kV, 500 V to 3 kV, 5 kV to 10 kV, 3 kV to 9 kV, 5 kV to 10 kV, and 25 kV to 35 kV fourth, fifth, sixth, seventh, and eighth grids $G_32$, $G_33$, $G_34$, $G_35$, $G_36$, $G_37$, and $G_38$, respectively.

In this state, three electron beams $B_R$, $B_G$, and $B_B$ are generated from cathodes $K_31$ in accordance with a modulation signal. The electron lens of the third embodiment is similar to that of the first embodiment shown in FIGS. 8 and 9, each of these electron beams is formed into crossover CO by means of first and second grids. Then, each electron beam is slightly focused into an imaginary crossover by means of prefocus lens PL, which formed of second and third grids. As shown in FIG. 14 electron beams $B_R$, $B_G$, and $B_B$ are diffused as they are rendered incident on third grid $G_33$. The electron beams, incident on third grid $G_33$, are slightly focused by means of the individual weak unipotential lenses, which are formed of third, fourth, and fifth grids $G_33$, $G_34$, and $G_35$. Thereafter, electron beams $B_R$, $B_G$, and $B_B$, incident on the parallel plate lenses formed of fifth, sixth, and seventh grids $G_35$, $G_36$, and $G_37$, are focused only in the vertical direction. Thus, the electron beams are focused more strongly in the vertical direction than in the horizontal direction. Thereafter, the electron beams are rendered incident on the large-aperture electron lens, which is formed of seventh and eighth grids $G_37$ and $G_38$. Thereupon, the electron beams are properly converged and focused by the large-aperture electron lens. Thus, electron beams $B_R$, $B_G$, and $B_B$ are landed with an appropriate beam spot configuration on the phosphor screen.

In this third embodiment, length b of two pairs of electric field control electrodes $G_37H$ of auxiliary electrode $G_37D$ is shorter than that of the electric control electrodes of the second embodiment. Therefore, the difference between the degrees of focus of the electron beams in the vertical and horizontal directions is smaller in this embodiment than in the first embodiment. Thus, electron beams $B_R$, $B_G$, and $B_B$ can be properly landed on the phosphor screen. The position of the center of each outside aperture of electrode $G_37D$ is situated outside the central axis of its corresponding outside apertures of grids $G_31$, $G_32$, $G_33$, and $G_34$, without being aligned therewith. In the horizontal plane (X-Z plane), therefore, the outside electron beams pass near the respective central axes of their corresponding astigmatic lenses, as in the first embodiment, so that comae are produced. Since the outside beams are subjected to a coma produced by the electron lens formed between seventh and eighth grids $G_37$ and $G_38$, however, the comae of the outside beams are canceled by the lenses. Thus, spots of the outside beams formed on the phosphor screen enjoy a satisfactory configuration. As in the case of the second embodiment, the electron beams are strongly focused in the vertical direction, so that the vertical focusing capability of the electron beams is improved. Thus, the vertical diameter of the beam spots can be reduced. As in the case of the first embodiment, furthermore, the vertical diameter of each electron beam is shorter than its horizontal diameter in the region where the electron beams are deflected, so that the beams cannot easily be subjected to a deflective aberration. In consequence, the shape of the beam spots in the peripheral region of the screen is improved.

In the second embodiment, the electric field control electrodes are arranged individually above and below the three electron beam apertures of the auxiliary electrode. In this third embodiment, on the other hand, the electric field control electrodes are arranged above and below only the outside electron beam apertures of the auxiliary electrode. In this arrangement, the difference in the degrees of focus between the outside electron beams and the central electron beam can be reduced. Thus, the outside and central beams can enjoy higher focusing capability than in the second embodiment.

In general, if a strong horizontal deflecting magnetic field of a pincushion-type is applied to the electron beams by means of the deflecting device, the beams are excessively focused on the peripheral region of the screen. In this embodiment, however, correction circuit 177, which is connected to sixth grid G36, changes the power of the electron lens in synchronism with the change of the state of deflection. Thus, deflection distortion of the electron beams is corrected, so that the beam spot shape is appropriate.

Figure 17:
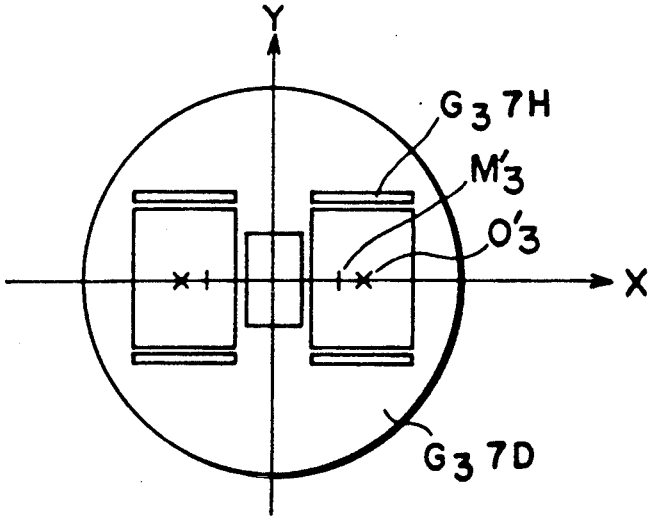
FIG. 17 is a plan view showing a modification of the configuration of auxiliary electrode $G_37D$.

The configuration of the auxiliary electrode is not limited to the one shown in FIG. 16, and the auxiliary electrode may alternatively be shaped as shown in FIG. 17. The parallel plate lenses may be bipotential lenses, instead of being unipotential lenses.

Figure 18:
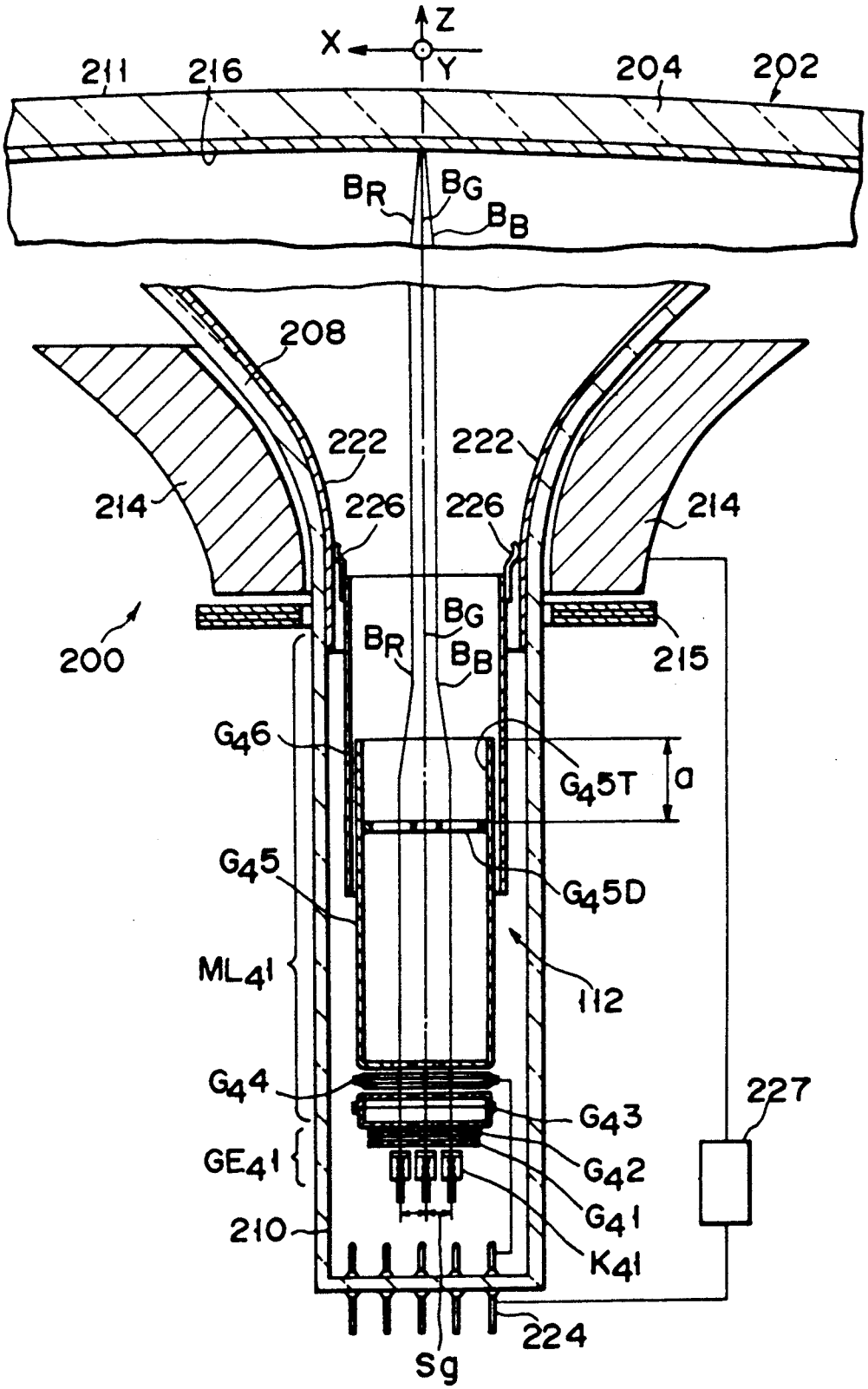
FIG. 18 is sectional view showing part of a color cathode ray tube apparatus according to a fourth embodiment of the present invention.

FIG. 18 shows part of a color cathode ray tube apparatus according to a fourth embodiment of the present invention. Color cathode ray tube apparatus 200 comprises envelope 211 which includes panel section 202, funnel section 208 bonded to panel section 202, and neck section 210 continuous with funnel section 208. Panel section 202 has substantially rectangular face plate 204 and a skirt (not shown) extending from the peripheral edge of plate 204. The inside of the color cathode ray tube is kept at a vacuum by sections 202, 208 and 210. Electron gun assembly 212 for emitting three electron beams $B_R$, $B_G$, and $B_B$ is housed inside neck section 210. Deflecting device 214, which includes horizontal and vertical deflecting coils, is mounted on the outer peripheral surfaces of funnel and neck sections 208 and 210. The horizontal and vertical deflecting coils serve to generate magnetic fields in order to deflect electron beams $B_R$, $B_G$, and $B_B$ horizontally and vertically, respectively. Multipolar magnet 215 for adjusting the tracks of the electron beams is mounted on neck section 210. Phosphor screen 216 is formed on the inner surface of face plate 204 of panel section 202. Inside the tube, a substantially rectangular shadow mask (not shown) is arranged opposite screen 216 so that a predetermined space is kept between the mask and face plate 204. The mask, which is formed of a metal sheet, has a number of perforations. Internal conductor film 222 is applied to the inner wall surface of part of envelope 211 between funnel and neck sections 208 and 210. A plurality of stem pins 224 is attached to the end portion of neck section 210.

Electron gun assembly 212 inside neck section 210 includes cathodes $K_41$, planar first grid $G_41$, planar second grid $G_42$, and third, fourth, fifth, and sixth grids $G_43$, $G_44$, $G_45$, and $G_46$. Sixth grid $G_46$ is provided with valve spacer 226 for supporting assembly 212. Electron gun assembly 212 is connected to stem pins 224. Further, correction circuit 227 is connected to fourth grid $G_44$ via stem pins 224. Circuit 227 supplies a voltage which changes in a parabolic configuration in synchronism with a current supplied to the deflecting device.

Figure 19:
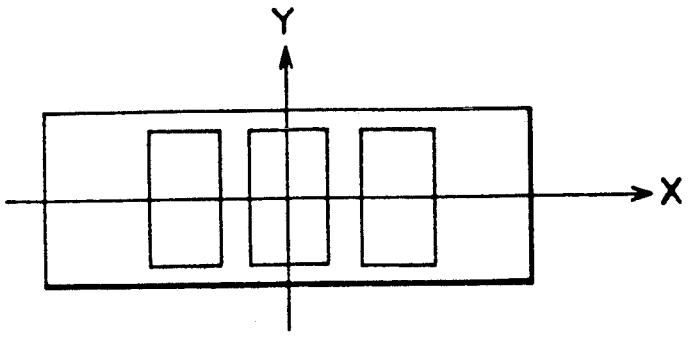
FIG. 19 is a plan view showing the configuration of grid $G_43$, or $G_45$.
Figure 20:
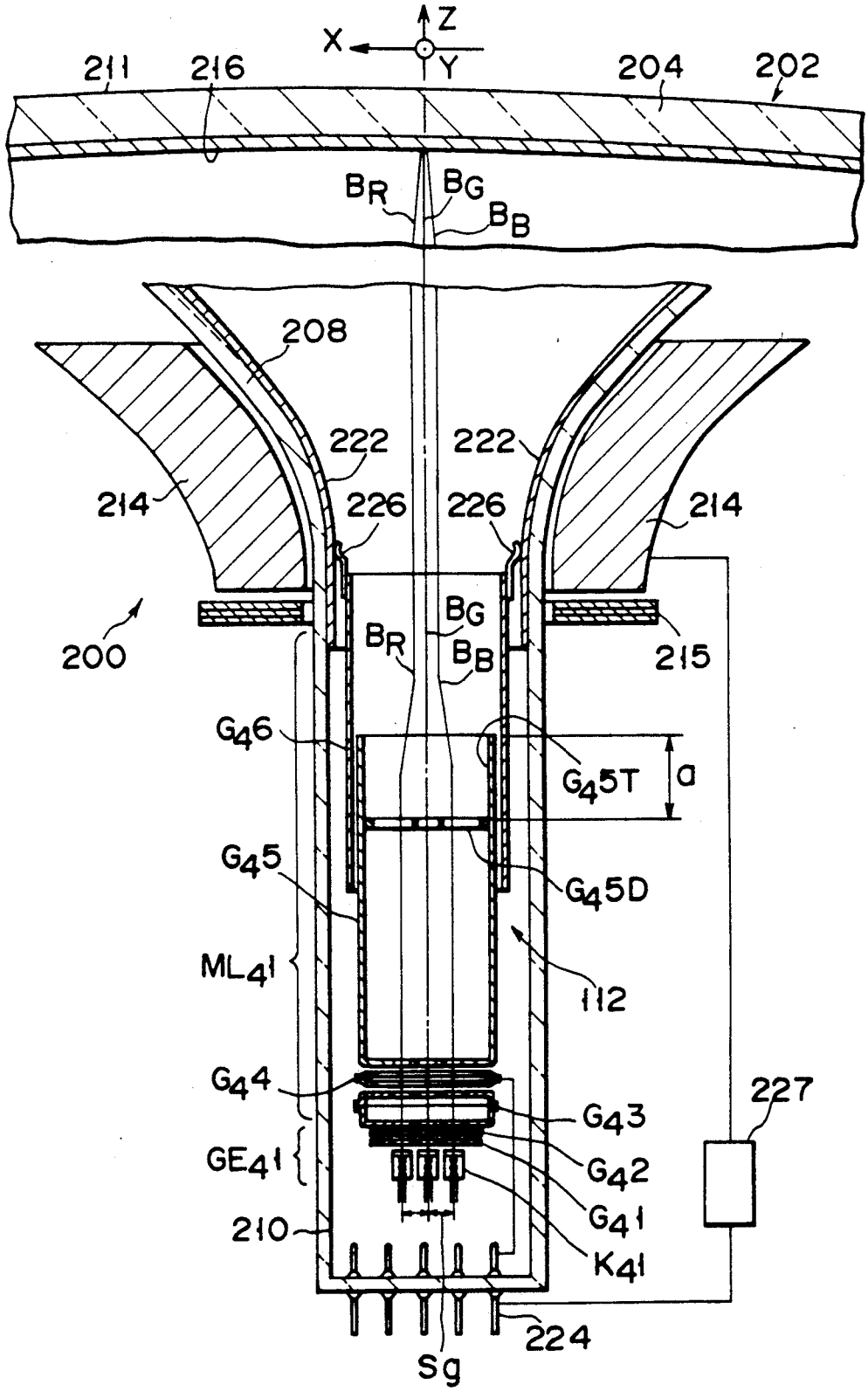
Figure 21:
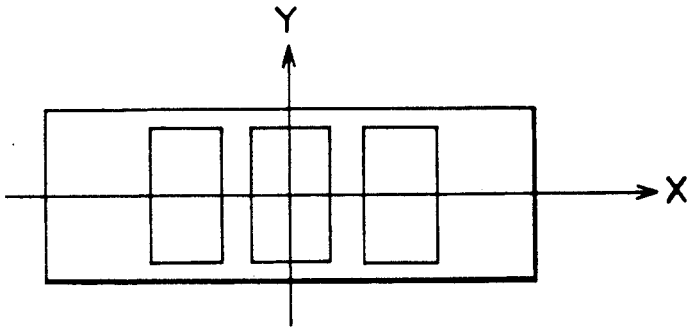

Each cathode $K_41$ has a heater (not shown) therein. First and second grids $G_41$ and $G_42$ are each provided with three small beam apertures corresponding to cathodes $K_41$. This portion constitutes electron beam forming unit $GE_41$. The configuration of electron beam apertures of third grid $G_43$ or fifth grid $G_45$, as viewed from the fourth-grid side, is shown in FIG. 19. These apertures are vertically elongated openings, three in each set. An electron beam aperture of fourth grid $G_44$, which is shown in FIG. 15, is a single slit long from side to side, as in the case of the third embodiment. Thus, unipotential lenses, which are formed of third, fourth, and fifth grids $G_43$, $G_44$, and $G_45$, are so-called four-pole lenses which focus the electron beams in the vertical direction, and diffuse them in the horizontal direction. Fifth and sixth grids $G_45$ and $G_46$ are formed in the same manner as their counterparts in the first embodiment.

All the electrodes of electron gun assembly 212 except sixth grid $G_46$ are supplied with voltage from stem pins 224. A cutoff voltage of about 150 V, involving a video signal, is applied to cathodes $K_41$. First grid $G_41$ is at an earth potential. Voltages of 500 V to 1 kV, 5 kV to 10 kV, 500 V to 10 kV, 5 kV to 10 kV, and 25 kV to 35 kV (high anode voltage) are applied to second, third, fourth, fifth, and sixth grids $G_42$, $G_43$, $G_44$, $G_45$, and $G_46$, respectively.

In this state, three electron beams $B_R$, $B_G$, and $B_B$ are generated from cathodes $K_41$ in accordance with a modulation signal. The electron lens of the fourth embodiment is similar to that of the first embodiment shown in FIGS. 8 and 9. Each of these electron beams is formed into crossover CO by means of first and second grids. Then, each electron beam is slightly focused into imaginary crossover by means of prefocus lens PL, which is formed of second and third grids. As shown in FIG. 18 electron beams $B_R$, $B_G$, and $B_B$ are diffused as they are rendered incident on third grid $G_43$. The electron beams, incident on third grid $G_43$, are separately focused in the vertical direction and diffused in the horizontal direction, by the individual four-pole lenses formed of third, fourth, and fifth grids $G_43$, $G_44$, and $G_45$. Thereafter, electron beams $B_R$, $B_G$, and $B_B$ are rendered incident on a large-aperture electron lens, which is formed of fifth and sixth grids grids $G_45$ and $G_46$. Thereupon, as in the case of the first embodiment, the electron beams are converged and focused on the phosphor screen by the large-aperture electron lens.

In general, if a strong horizontal deflecting magnetic field of a pincushion-type is applied to the electron beams by means of the deflecting device, the beams are excessively focused on the peripheral region of the screen. In this embodiment, however, correction circuit 227, which is connected to sixth grid $G_46$, changes the power of the electron lens in synchronism with the change of the state of deflection. Thus, deflection distortion of the electron beams is corrected, so that the beam spot shape is appropriate.

In the embodiment described above, auxiliary electrode $G_45D$ in fifth grid $G_45$ have the three rectangular apertures. As shown in FIG. 10, however, three substantially circular apertures may be bored through the fifth grid. Although the four-pole lenses are unipotential lenses in the above embodiment, they may alternatively be formed of bipotential lenses.

According to the present invention, as described above, the large-aperture electron lens enables the three electron beams to be converged and focused most suitably on the phosphor screen. Thus, the beam spots can be made very small, so that the performance of the color cathode ray tube apparatus can be improved.

What is claimed is:

1. A color cathode ray tube apparatus comprising:

a vacuum envelope including a panel section, a funnel section, and a neck section, the panel section having a rectangular face plate which has an inner surface, and having a skirt extending from a peripheral edge of the face plate, the neck section being formed in a cylindrical shape, the funnel section being continuous with the neck section;

a phosphor screen formed on the inner surface of the face plate;

a shadow mask arranged inside the panel section, facing the phosphor screen;

an in-line electron gun assembly housed in the neck section, the assembly having an electron beam forming unit for generating, controlling, and accelerating three electron beams, including one central electron beam and two outside electron beams having central axes, and a main electron lens unit for converging and focusing the three electron beams; and a deflecting device for vertically and horizontally deflecting the electron beams emitted from the electron gun assembly, wherein:

the main electron lens unit includes a large-aperture electron lens serving the three electron beams in common, and individual electron lenses comprising one central electron lens and two outside electron lenses, the central and outside lenses serving, respectively, the central and outside electron beams whereby the large-aperture lens causes a first aberration when the outside electron beams pass therethrough, and the outside lenses cause a second aberration which cancels the first aberration within a region of the large-aperture electron lens, the respective central axes of the three electron beams incident on the large-aperture electron lens are parallel to one another, and means is provided on the side of the electron beam forming unit closest to the large-aperture lens, for forming the three electron beams diffusing more strongly in the horizontal direction than in the vertical direction.

2. A color cathode ray tube apparatus comprising:

a vacuum envelope including a panel section, a funnel section, and a neck section, the panel section having a rectangular face plate which has an inner surface, and having a skirt extending from a peripheral edge of the face plate, the neck section being formed in a cylindrical shape, the funnel section being continuous with the neck section;

a phosphor screen formed on the inner surface of the face plate;

a shadow mask arranged inside the panel section, facing the phosphor screen;

an in-line electron gun assembly housed in the neck section, the assembly having an electron beam forming unit for generating, controlling, and accelerating three electron beams, including one central electron beam and two outside electron beams having central axes, and a main electron lens unit for converging and focusing the three electron beams; and a deflecting device for vertically and horizontally deflecting the electron beams emitted from the electron gun assembly, wherein:

the main electron lens unit includes a large-aperture electron lens serving the three electron beams in common, and individual electron lenses comprising one central electron lens and two outside electron lenses, the central and outside lenses serving, respectively, the central and outside electron beams whereby the large-aperture lens causes a first aberration when the outside electron beams pass therethrough, and the outside lenses cause a second aberration which cancels the first aberration within a region of the large-aperture electron lens, and focusing force correcting means situated within the region of the large-aperture electron lens, the correcting means being adapted to strengthen the vertical focusing force on at least one of the electron beams.

3. A color cathode ray tube apparatus comprising:

a vacuum envelope including a panel section, a funnel section, and a neck section, the panel section having a rectangular face plate which has an inner surface, and having a skirt extending from a peripheral edge of the face plate, the neck section being formed in a cylindrical shape, the funnel section being continuous with the neck section;

a phosphor screen formed on the inner surface of the face plate;

a shadow mask arranged inside the panel section, facing the phosphor screen;

an in-line electron gun assembly housed in the neck section, the assembly having an electron beam forming unit for generating, controlling, and accelerating three electron beams, including one central electron beam and two outside electron beams having central axes, and a main electron lens unit for converging and focusing the three electron beams; and a deflecting device for vertically and horizontally deflecting the electron beams emitted from the electron gun assembly, wherein:

the main electron lens unit includes a large-aperture electron lens serving the three electron beams in common, and individual electron lenses comprising one central electron lens and two outside electron lenses, the central and outside lenses serving, respectively, the central and outside electron beams whereby the large-aperture lens causes a first aberration when the outside electron beams pass therethrough, and the outside lenses cause a second aberration which cancels the first aberration within a region of the large-aperture electron lens, focusing force correcting means is situated within the region of the large-aperture electron lens, the correcting means being adapted to strengthen the vertical focusing force on at least one of the electron beams, and means is provided for forming individual electron beams diffusing more strongly in the horizontal direction than in the vertical direction so that the respective central axes of the three electron beams are parallel to one another, the beam forming means being provided on the side of the electron beam forming unit nearest the large-aperture electron lens.

4. A color cathode ray tube apparatus comprising:

a vacuum envelope including a panel section, a funnel section, and a neck section, said panel section having an axis and a face plate, the front-view shape of which is substantially rectangular and which has an inner surface, and having a skirt extending from the peripheral edge of the face plate, said neck section being formed in a substantially cylindrical shape, said funnel section being continuous with the neck section;

a phosphor screen formed on the inner surface of the face plate;

a shadow mask arranged inside the panel section so as to face the phosphor screen on the face plate;

an in-line electron gun assembly housed in the neck section, said assembly having an electron beam forming unit for generating, controlling, and accelerating three electron beams, including one central electron beam and two outside electron beams, and a main lens unit for converging and focusing the three electron beams; and a deflecting device for vertically and horizontally deflecting the electron beams emitted from the electron gun assembly, characterized in that said main electron lens unit includes a large-aperture electron lens having at least a first cylindrical electrode through which the three electron beams are passed in common, a second cylindrical electrode containing the first cylindrical electrode, and an auxiliary electrode disposed inside the first cylindrical electrode and having three beam apertures through which the three electron beams are passed individually, the respective central axes of the three electron beams incident on said large-aperture electron lens are substantially parallel to one another, and means for forming individual electron beams diffusing relatively more strongly in the horizontal direction than in the vertical direction is provided on the side of the electron beam forming unit with respect to the large-aperture electron lens.

5. The color cathode ray tube apparatus according to claim 4, wherein the shape of said central electron beam aperture, out of the three beam apertures of the auxiliary electrode, is different from the shape of the outside electron beam apertures.

6. The color cathode ray tube apparatus according to claim 4, wherein said means for forming the individual electron beams diffusing relatively more strongly in the horizontal direction than in the vertical direction is an electrode having a beam aperture which has a horizontal diameter that is longer than a vertical diameter thereof.

7. The color cathode ray tube apparatus according to claim 5, wherein said means for forming the individual electron beams diffusing relatively more strongly in the horizontal direction than in the vertical direction is an electrode having a beam aperture which has a horizontal diameter that is longer than a vertical diameter thereof.

8. The color cathode ray tube apparatus according to claim 4, wherein said means for forming the individual electron beams diffusing relatively more strongly in the horizontal direction than in the vertical direction is a four-pole lens.

9. The color cathode ray tube apparatus according to claim 5, wherein said means for forming the individual electron beams diffusing relatively more strongly in the horizontal direction than in the vertical direction is a four-pole lens.

10. The color cathode ray tube apparatus according to claim 4, wherein said three electron beams incident on the large-aperture electron lens and having substantially parallel central axes are arranged so that three cathodes and beam apertures of an electrode of the beam forming unit adjacent thereto are on a straight line, and that the cathodes and the beam apertures on the straight line are parallel to one another.

11. The color cathode ray tube apparatus according to claim 5, wherein said three electron beams incident on the large-aperture electron lens and having substantially parallel central axes are arranged so that three cathodes and beam apertures of an electrode of the beam forming unit adjacent thereto are on a straight line, and that the cathodes and the beam apertures on the straight line are parallel to one another.

12. The color cathode ray tube apparatus according to claim 6, wherein said three electron beams incident on the large-aperture electron lens and having substantially parallel central axes are arranged so that three cathodes and beam apertures of an electrode of the beam forming unit adjacent thereto are on a straight line, and that the cathodes and the beam apertures on the straight line are parallel to one another.

13. The color cathode ray tube apparatus according to claim 8, wherein said three electron beams incident on the large-aperture electron lens and having substantially parallel central axes are arranged so that three cathodes and beam apertures of an electrode of the beam forming unit adjacent thereto are on a straight line, and that the cathodes and the beam apertures on the straight line are parallel to one another.

14. A color cathode ray tube apparatus comprising:

a vacuum envelope including a panel section, a funnel section, and a neck section, said panel section having an axis and a face plate, the front-view shape of which is substantially rectangular and which has an inner surface, and having a skirt extending from the peripheral edge of the face plate, said neck section being formed in a substantially cylindrical shape, said funnel section being continuous with the neck section;

a phosphor screen formed on the inner surface of the face plate;

a shadow mask arranged inside the panel section so as to face the phosphor screen on the face plate;

an in-line electron gun assembly housed in the neck section, said assembly having an electron beam forming unit for generating, controlling, and accelerating three electron beams, including one central electron beam and two outside electron beams, and a main lens unit for converging and focusing the three electron beams; and a deflecting device for vertically and horizontally deflecting the electron beams emitted from the electron gun assembly, characterized in that said main electron lens unit includes a large-aperture electron lens having at least a first cylindrical electrode through which the three electron beams are passed in common, a second cylindrical electrode containing the first cylindrical electrode, and an auxiliary electrode disposed inside the first cylindrical electrode and having three beam apertures through which the three electron beams are passed individually, the respective central axes of the three electron beams incident on said large-aperture electron lens are substantially parallel to one another, and means for forming individual electron beams diffusing relatively more strongly in the horizontal direction than in the vertical direction is provided on the side of the electron beam forming unit with respect to the large-aperture electron lens.

15. The color cathode ray tube apparatus according to claim 14, wherein the shape of said central electron beam aperture, out of the three beam apertures of the auxiliary electrode, is different from the shape of the outside electrode beam apertures.

16. The color cathode ray tube apparatus according to claim 14, wherein said means for forming the individual electron beams diffusing relatively more strongly in the horizontal direction than in the vertical direction is an electrode having a beam aperture which has a horizontal diameter that is longer than a vertical diameter thereof.

17. The color cathode ray tube apparatus according to claim 14, wherein said means for forming the individual electron beams diffusing relatively more strongly in the horizontal direction than in the vertical direction is a four-pole lens.

18. The color cathode ray tube apparatus according to claim 14, wherein said three electron beams incident on the large-aperture electron lens and having substantially parallel central axes are arranged so that three cathodes and beam apertures of an electrode of the beam forming unit adjacent thereto are on a straight line, and that the cathodes and the beam apertures on the straight line are parallel to one another.

* * * * *